United States Patent [19]

Frey

[11] 4,400,156

[45] Aug. 23, 1983

[54] GAS BURNER

[75] Inventor: Markus Frey, Regensdorf, Switzerland

[73] Assignee: Febrag AG Watt, Watt, Switzerland

[21] Appl. No.: 322,236

[22] Filed: Nov. 17, 1981

[30] Foreign Application Priority Data

Dec. 3, 1980 [CH] Switzerland ..... 8917/80

[51] Int. Cl.[3] ..... F24H 1/00; F23D 13/40

[52] U.S. Cl. ..... 432/222; 431/354

[58] Field of Search ..... 431/354; 432/222, 8, 432/59

[56] References Cited

U.S. PATENT DOCUMENTS

| | | | |
|---|---|---|---|
| 3,617,224 | 11/1971 | Brun-Tsekhovoi et al. | 431/254 |
| 3,787,169 | 1/1974 | Gjerde | 431/354 |
| 3,834,854 | 9/1974 | Vanderveen | 431/173 |
| 3,874,091 | 4/1975 | Fukumoto | 432/59 |
| 4,082,497 | 4/1978 | Crawford et al. | 432/222 |
| 4,218,426 | 8/1980 | Dahmen | 431/173 |
| 4,345,897 | 8/1982 | Stanton | 432/222 |

*Primary Examiner*—John J. Camby

*Attorney, Agent, or Firm*—Ernest F. Marmorek

[57] ABSTRACT

In a gas burner arrangement which has at least one burner, and a mixing chamber for mixing entering air and fuel, includes, in combination, a conduit which establishes intercommunication between the mixing chamber and the burner, an expansion chamber communicating with the mixing chamber, and a burner channel communicating with the expansion chamber and the burner, respectively, so that air and fuel entering the mixing chamber will be intermixed and the resulting mixture will proceed therefrom through the expansion chamber and subsequently through the burner channel to the burner.

9 Claims, 3 Drawing Figures

GAS BURNER

BACKGROUND OF THE INVENTION

The present invention relates to a gas burner arrangement having at least one burner and a mixing chamber for mixing entering air and fuel and use of the gas burner arrangement in a heat exchanger for generating hot air, particularly for drying plants and heating purposes.

Various gas burners are known in the prior art. In one such gas burner the gas is mixed with the air shortly ahead of the flame zone, or in the flame zone itself, while in another category of gas burners, gas and air are mixed ahead of the flame zone, and at the burner nozzle a mixture of gas and air is available which can be ignited.

Only gas burners where the air is pre-mixed with the gas are used for industrial purposes, as these can generate higher flame temperatures. Usually gas is injected into a tube via a nozzle. The resulting flow draws air through large-dimensioned openings to the tube, which subsequently is mixed with a gas and ignited at the other end of the tube.

In other implementation forms of burners the gas and air are passed through two tubes, respectively, which converge in the flame region.

Known burners have the disadvantage that they are not suitable for generation of hot air, particularly when it they are required temporarily to operate at a partial load, namely at a reduced heat delivery.

SUMMARY OF THE INVENTION

One of the principal objects of the present invention is to avoid the disadvantages of the prior art and to devise a gas burner arrangement, in which complete combustion takes place at all load ranges, and therefore a high effectiveness is obtained.

It is a further object of the present invention to use the gas burner arrangement to generate hot air for heating and drying purposes.

This object is attained in a gas burner arrangement having at least one burner and a mixing chamber for mixing entering air and fuel, by providing a conduit establishing intercommunication between the mixing chamber and the burner, and including an expansion chamber communicating with the mixing chamber, and a burner channel communicating with the expansion chamber and the burner, respectively, so that air and fuel entering the mixing chamber will be intermixed, and the resulting mixture will proceed therefrom through the expansion chamber and subsequently through the burner channel to the burner.

Another object of the invention is obtained by a heat exchanger using a gas burner arrangement as described for generating hot air, and including a housing accommodating the gas burner arrangement, and wherein air to be warmed enters the housing, streams past the gas burner arrangement, and receives heat therefrom.

Further objects and advantages of the invention will be set forth in part in the following specifications, and in part will be obvious therefrom without being specifically referred to, the same being realized and attained as pointed out in the claims hereof.

BRIEF DESCRIPTION OF THE DRAWINGS

For a fuller understanding of the nature and objects of the invention, reference should be had to the following detailed description, taken in connection with the accompanying drawings in which.

DESCRIPTION OF THE PREFERRED EMBODIMENTS

Figure 1:
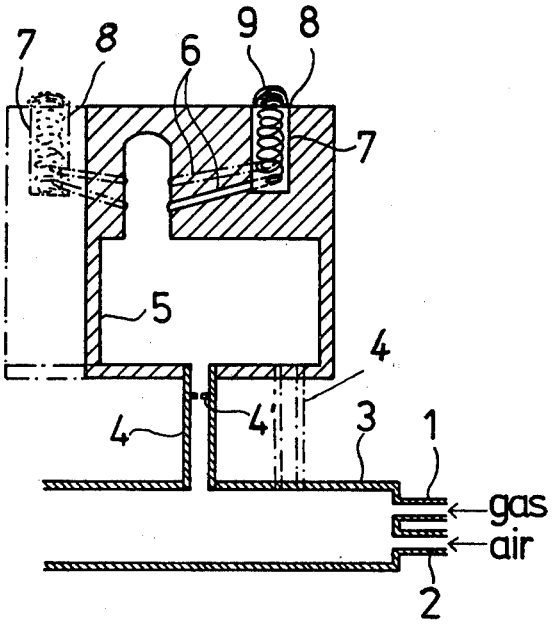
FIG. 1 is a longitudinal section through the gas burner arrangement.

In carrying the invention into effect, as best seen from FIG. 1, fuel, such as gas, and air are passed into a mixing chamber 3 in proportions suitable to obtain complete combustion, and are mixed with one another therein. Through a delivery passage 4 the fuel and air mixture passes to a second mixture chamber or expansion chamber 5, and is further thoroughly mixed therein. Through an intermediate passage 6, which is disposed substantially tangentially to a closed end of a burner channel 7, the fuel mixture passes at a velocity in the range of about 150 feet per second to about 600 feet per second to the flame zone 8. The cross-sections of the passages 4 and 6 are such that the operative velocity of the fuel mixture in each passage exceeds its ignition velocity therein under all operative conditions, for example, at full or partial loads, for any arbitrary fuel mixtures, including hydrogen.

As a result of the tangential entry of the fuel mixture into the burner channel 7 the fuel mixture flows in a helical manner to the flame zone 8, and gives rise there to a cap-shaped and very hot flame 9.

The delivery passage 4, which may also include a stop 4', as well as the intermediate passage 6 in which the fuel mixture flows at a velocity in the range of 150 feet per second to about 600 feet per second, preferably from about 200 feet per second to about 450 feet per second, act in the nature of check valves in the event of a pressure reduction in the mixing chamber 3.

Figure 2:
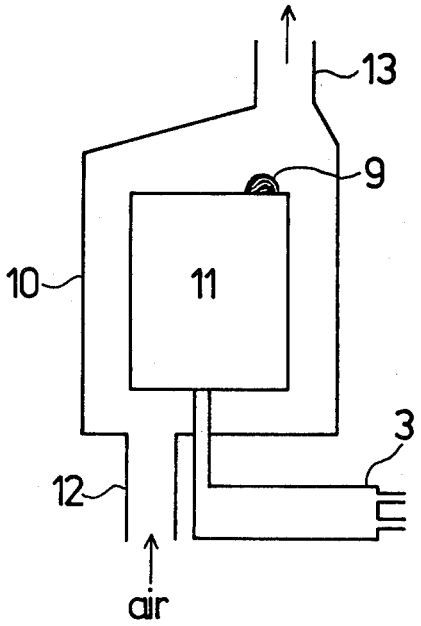
FIG. 2 is a heat exchanger using the gas burner arrangement according to the present invention.

In view of the relatively short flame 9 the gas burner arrangement is position-independent. Any changes in pressure, which occur in industrial use, are equalized by the mixing chamber 3 and the expansion chamber 5, which act as storage chambers. Any reduction in pressure down to about 30% of the nominal value required for the burner does not cause the flame 9 to be extinguished, even if it is disposed in an air stream. The gas burner arrangement described is very suitable for generation of hot air. In FIG. 2, there is shown a heat exchanger, in which the gas burner arrangement is used to generate hot air.

In FIG. 2 there is shown a gas burner arrangement 11 accommodated in a housing 10. Air is supplied into the housing 10 through an opening 12 and streams past the gas burner arrangement 11, and finally past the flame 9. The heated air is discharged through an opening 13 to a user.

Figure 3:
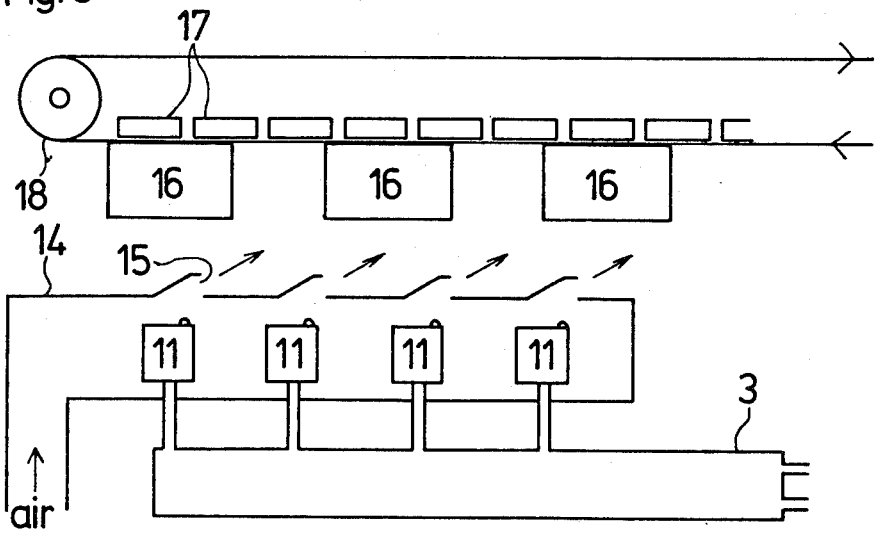
FIG. 3 is a system using a plurality of gas burner arrangements in a heat exchanger serving the drying path, shown in longitudinal section.

It is of course within the scope of this invention to use a plurality of gas burner arrangements 11 in a common housing, as shown schematically in FIG. 3. The heated air may be discharged either through a single opening or through a plurality of openings 15. For example it is possible to pass hot air through the openings 15, shown arranged in series, which impinges on work pieces transported past the opening, for example freshly lacquered can components or sleeves 16, which are suspended from a transport system 18, provided with magnets 17.

When used in a heat exchanger, the housing 10 is continuously cooled by the air supplied thereto, namely the gas burner arrangement remains cool, and does not have to be insulated. The air stream entering the housing 10 is therefore preheated upon reaching the flame 9. The entire heat generated by the gas burner arrangement 11 is passed to the atmosphere and remains at the disposal of the user for its final use. Energy savings of about 85% compared to convection heating systems are possible.

It is of course possible to use the above-described arrangement generating hot air for any other arbitrary purpose, for example heating of large rooms, for bending and smoothing of synthetic materials and the like. The gas burner arrangement according to the invention as well as its use in generating hot air has substantial advantages compared to known arrangements. The gas burner arrangement 11 is of a simple construction and can be manufactured at low cost. It is unnecessary to further insulate the housing for the gas burner arrangement.

The gas burner arrangement 11 does not require any maintenance, as it does not contain any moving parts, nor any check valves or nozzles sensitive to dirt accumulation.

Mixture of the fuel or gas with the air may take place in a central region outside of the burner or within the burner. As the streaming air acts as carrier for the heat energy, the energy can be supplied to the user immediately and without any losses. Any transport by means of conveying means warmed by a gas flame is unnecessary. Operation to full load is achieved within seconds; operation at partial load is made possible by reducing the pressure in the feed conduit. When the gas burner arrangement is used to generate hot air in drying plants, liquids to be evaporated, for example, solvents, are discharged by the air stream.

Under favorable conditions the "used" hot air may be resupplied either partially or wholly by the user through the gas burner arrangement, and reheated.

In a typical plant gas consumption was reduced by the user from about 7.5 kg. to about 2.5 kg. per unit time.

I wish it to be understood that I do not desire to be limited to the exact details of construction and described, for obvious modifications will occur to a person skilled in the art.

Having thus described the invention, what I claim as new and desire to be secured by Letters Patent is as follows:

1. In a gas burner arrangement having at least one burner, and a mixing chamber for mixing entering air and fuel, in combination means establishing a conduit between said mixing chamber and said burner, said conduit including an expansion chamber downstream of and communicating with said mixing chamber, and said conduit including a burner channel downstream of and communicating with said expansion chamber and with said burner, respectively, whereby air and fuel entering said mixing chamber will be intermixed, and the resulting mixture will proceed therefrom through said conduit to the burner, wherein said burner channel has an open end, said conduit further comprising a delivery passage establishing the communication between said mixing chamber and said expansion chamber, and said conduit including an intermediate passage establishing the communication between said expansion chamber and said burner channel, whereby the conduit will supply said mixture to a flame developed at the open end of said burner channel, wherein each of said passages has a predetermined cross-section, the cross-section of each passage being sized so that a selected fuel mixture will have an operative velocity of the fuel mixture throughout the conduit which exceeds its ignition velocity therein.

2. In a gas burner arrangement as claimed in claim 1, wherein said intermediate passage terminates substantially tangentially to said burner channel.

3. In a gas burner arrangement as claimed in claim 1, wherein the conduit generates an operative velocity in each passage in the range of from about 150 feet per second to about 600 feet per second.

4. In a gas burner arrangement as claimed in claim 3, wherein the operative velocity is in the range of from about 240 feet per second to about 450 feet per second.

5. In a gas burner arrangement as claimed in claim 2, wherein said burner channel and said intermediate passage communicating therewith are so proportioned that a vortex arises when the fuel mixture passes through said burner channel to feed the flame.

6. In a gas burner arranged as claimed in claim 1, a second burner, said conduit further comprising a second burner channel establishing communication with said expansion chamber and said second burner.

7. A heat exchanger using a gas burner arrangement as claimed in claim 1, for generating hot air, further comprising a housing accommodating said gas burner arrangement, and wherein air to be warmed entering said housing streams past said gas burner arrangement, and receives heat therefrom.

8. A heat exchanger as claimed in claim 7, wherein said gas burner arrangement is cooled and insulated by the air entering through said housing and streaming past said gas burner arrangement.

9. A heat exchanger as claimed in claim 7, wherein the air leaving said heat exchanger is flame-heated by said gas burner arrangement.

* * * * *